US006074589A

United States Patent [19]

Rapp et al.

[11] Patent Number: 6,074,589

[45] Date of Patent: Jun. 13, 2000

[54] TOOL FOR CUTTING AND SHAPING AN UNFINISHED CONCRETE ROOFING TILES AND A METHOD FOR USING A TOOL FOR CUTTING AND SHAPING UNFINISHED ROOFING TILES

[75] Inventors: Helmut Rapp, Rodgau; Heinrich Stephan, Rüsselsheim; Frank Wojtalewicz, Wiesbaden, all of Germany

[73] Assignee: Braas GmbH, Oberursel, Germany

[21] Appl. No.: 09/002,455

[22] Filed: Jan. 2, 1998

Related U.S. Application Data

[63] Continuation-in-part of application No. PCT/DE96/01143, Jun. 22, 1996.

[30] Foreign Application Priority Data

Jul. 4, 1995 [DE] Germany ..... 195 24 315

[51] Int. Cl.[7] ..... B28B 11/14

[52] U.S. Cl. ..... 264/163; 425/295; 425/297; 425/298; 425/299

[58] Field of Search ..... 264/163; 425/295, 425/299, 297, 298

[56] References Cited

U.S. PATENT DOCUMENTS

| | | | |
|---|---|---|---|
| 5,223,200 | 6/1993 | Schulz et al. | 264/163 |
| 5,580,305 | 12/1996 | McFarland | 425/138 |
| 5,746,870 | 5/1998 | Tomioka et al. | 264/163 |
| 5,809,860 | 9/1998 | Haaser | 264/163 |

FOREIGN PATENT DOCUMENTS

| | | |
|---|---|---|
| 2009149 | 1/1970 | France . |
| 2608090 | 6/1988 | France . |
| 3100673 | 8/1982 | Germany . |
| 3522846 | 1/1987 | Germany . |
| 3712700 | 11/1988 | Germany . |

*Primary Examiner*—Jan H. Silbaugh
*Assistant Examiner*—Dae Young Lee
*Attorney, Agent, or Firm*—Nils H. Ljungman & Associates

[57] ABSTRACT

A tool for cutting and shaping a lower edge of a profiled unfinished concrete roofing tile manufactured using the extrusion method, having a tool holder, a cutting insert provided with a cutting edge, and a template. To create a tool which has a significantly increased useful life for cutting and shaping an unfinished concrete roofing tile, the invention teaches that the tool holder and the template are realized in one piece in the form of a support body with a recess for the adhesive and positive connection of the cutting insert, that the cutting insert is made of tungsten carbide and is fastened in the recess by means of adhesive, and that the cutting insert is in contact by means of its upper edge with at least one projection of the support body.

10 Claims, 2 Drawing Sheets

TOOL FOR CUTTING AND SHAPING AN UNFINISHED CONCRETE ROOFING TILES AND A METHOD FOR USING A TOOL FOR CUTTING AND SHAPING UNFINISHED ROOFING TILES

CONTINUING APPLICATION DATA

This application is a Continuation-In-Part application of International Application No. PCT/DE96/01143, filed on Jun. 22, 1996, which claims priority from Federal Republic of Germany Patent Application No. 195 24 315.3, filed on Jul. 4, 1995. International Application No. PCT/DE96/01143 was pending as of the filing date of the above-cited application. The U.S. was an elected state in International Application No. PCT/DE96/01143.

BACKGROUND OF THE INVENTION

1. Field of the Invention

The present invention relates to a tool for cutting and shaping the lower edge of a profiled unfinished concrete roofing tile manufactured using the extrusion method, whereby the tool has a tool holder, a cutting insert or tip provided with a cutting edge and a template.

2. Background Information

German Patent 35 22 846 C3, FIGS. 5–7, which corresponds to U.S. Pat. Nos. 5,004,415 and 5,223,200, describes a known tool for cutting and shaping the lower edge of profiled unfinished concrete roofing tiles manufactured using the extrusion method. The tool can be attached by way of a tool holder to a pneumatic cylinder which pneumatic cylinder moves the tool. Bolted to the tool holder is a cutting insert or tip, to which tip a template made of abrasion-resistant plastic is fastened. The tool is conventionally oriented at an angle with respect to the lower, perpendicular transverse plane of the unfinished concrete roofing tile, so that the cutting insert executes an inclined cut, at which cut a short piece is separated from the lower edge of the unfinished concrete roofing tile and the lower edge of the template is deformed.

In the known tool, the force necessary to shape the lower edge using the cutting insert is transmitted by the tool holder to the template, which means that the cutting insert is exposed to a high level of impact and bending stress when the tool is in the inclined position. As the cutting insert penetrates the extremely dense unfinished concrete roofing tile, the cutting insert is also exposed to a severe abrasive stress. Because in the known tool it has been determined that the impact and bending stresses are significantly more critical, the cutting insert of the known tool is manufactured from a tough material which is not very resistant to abrasion, and therefore the useful life of the tool is very short.

To increase the life expectancy of the tool, attempts have been made in which the surface of the cutting insert has been hardened or provided with an abrasion-resistant coating. The results of such attempts, however, have been unsatisfactory, because the abrasion-resistant but brittle coatings crack and ultimately chip off of the cutting insert.

OBJECT OF THE INVENTION

The object of the invention is to create a tool which has a significantly longer useful life for cutting and shaping an unfinished concrete roofing tile of the type described above.

SUMMARY OF THE INVENTION

The present invention teaches that this object can be achieved by realizing the tool holder and the template in one piece in the form of a support body with a recess for the fastening of the cutting insert by means of a positive and adhesive connection, by manufacturing the cutting insert from carbide, such as tungsten carbide, and by fastening it in the recess by means of adhesive, and by having the cutting insert in contact by means of its upper edge with at least one projection of the support body.

As a result of the one-piece realization of the tool holder and the template, the force required to shape the lower edge is transmitted directly from the tool holder into the template. In this manner, the cutting insert remains essentially free of impact and bending stresses, even when the tool is in an inclined position, which means that it is possible to specially adapt the characteristics of the material used to make the cutting insert so that the cutting insert is resistant to abrasion. The cutting insert can therefore be made from a material which is more brittle, but significantly more resistant to abrasion, than has heretofore been possible.

To further explain, in at least one embodiment of the present invention, by realizing the tool holder and the template which shapes the lower edge of the tile as one-piece, the shaping force exerted, for example by a pneumatic cylinder, can be transmitted directly from the tool holder into the template. In this manner, the cutting insert, which is attached to the one-piece tool holder and template, can remain essentially free of impact and bending stresses, even when the tool is in an inclined position. This decrease in impact and bending stress on the cutting tool permits the use of a material for the cutting insert which is more resistant to abrasion, than has heretofore been possible.

Because the cutting insert can be glued to the support body over a large surface area in the vicinity of the recess in the support body, and the upper edge of the cutting insert is in contact with at least one projection of the support body, any potential bending of the cutting insert as a result of the compression force which occurs during cutting is essentially prevented.

An example of the environment in which at least one embodiment of the present invention can be used can be found in German Patent 35 22 846 C3.

Tests to determine the useful life of the cutting insert which were conducted with the tool in accordance with the present invention showed that the tool in accordance with the present invention has a useful life which is 10 times longer than known tools, as a result of the special constructive configuration of the support body and the selection of the carbide or tungsten carbide which can be used to make the cutting insert.

A particularly secure adhesive connection between the cutting insert and the support body can be achieved if the side of the cutting insert which faces the support body is in contact over at least ⅔ of its surface area with the support body, so that there is a large area available for the adhesive connection.

The cutting insert of the tool can be made of a special tungsten carbide which, in addition to its high resistance to abrasion, has a high degree of toughness. Preferably, the tungsten carbide used is in Group G 40.

Unfinished concrete roofing tiles can be shaped on a profiled chase, or the bottom part of a mold, and for that purpose can have a profiling on their undersides. To be able to cut profiled unfinished concrete roofing tiles, the cutting edge of the cutting insert can have a contour which is provided with curved notches of different depths, whereby the depth T of the notches corresponds to the height of the profile on the underside of the unfinished concrete roofing tile. The contour of the cutting edge simultaneously corresponds to the profiled surface of the chase on which the unfinished concrete roofing tile was shaped or molded.

On a profiled unfinished concrete roofing tile, the side rabbets and the center flap are higher than the gutters or drains which are located between the center flap and the side rabbets. When the unfinished concrete roofing tile is cut with a tool set diagonally with a plane cutting insert, the side rabbets, center flap and gutters of the unfinished concrete roofing tile are chamfered, beginning from the upper side and proceeding toward the underside, whereby the higher side rabbets and the center flap are cut more severely or sharply than the gutters. The cut surface which is formed on the lower edge of the concrete roofing tile runs at an angle to the lower perpendicular transverse plane of the unfinished concrete roofing tile.

To give the unfinished concrete roofing tile the most appropriate possible external appearance, the lower edge, at least in the vicinity of its lower edge, such as its extreme lower edge, should run in the lower perpendicular transverse plane of the unfinished concrete roofing tile. This can be accomplished very easily if the cutting insert of the tool which is set at an angle $\alpha$ to the lower perpendicular transverse plane has cambers, such as convex portions or bulges, whereby each camber x is proportional to the depth T of the notches in the contour of the cutting edge and to sin $\alpha$. The camber x to be formed into the cutting insert is calculated on the basis of the mathematical equation $x=T\cdot\sin\alpha$.

The above discussed embodiments of the present invention will be described further hereinbelow with reference to the accompanying figures.

When the word "invention" is used in this specification, the word "invention" includes "inventions", that is, the plural of "invention." By stating "invention," the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

One preferred embodiment of the invention is illustrated in the accompanying drawings, and is explained in greater detail below, with reference to the accompanying figures, wherein.

DESCRIPTION OF THE PREFERRED EMBODIMENT

Figure 1:
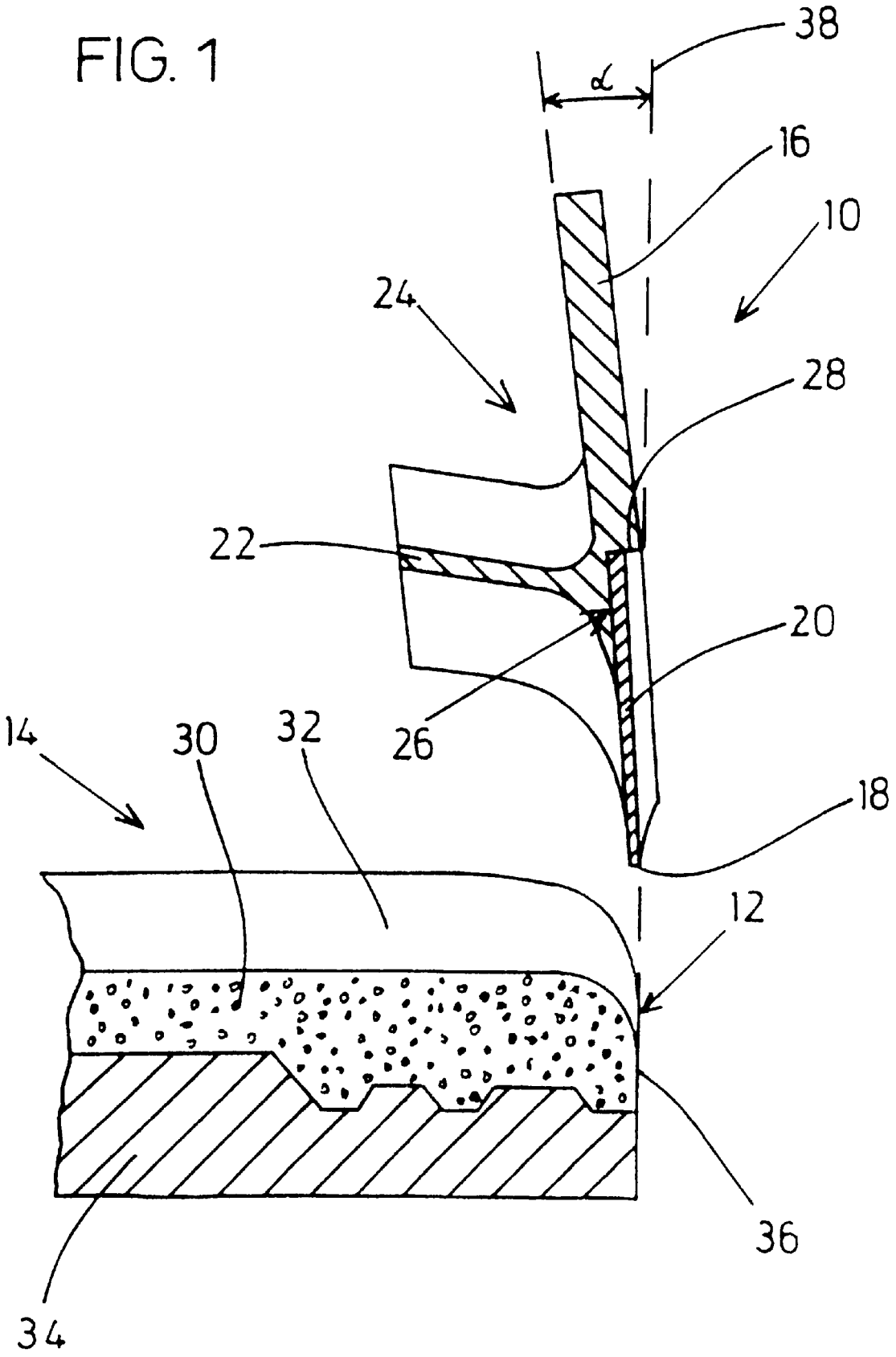
FIG. 1 is a cross section which shows a tool in accordance with the present invention for cutting and shaping an unfinished concrete roofing tile.

FIG. 1 illustrates, in cross section, a tool 10 in accordance with the present invention, for cutting and shaping the lower edge 12 of an unfinished concrete roofing tile 14 manufactured using the extrusion method. The tool 10 has a tool holder 16, a cutting insert 20 provided with a cutting edge 18, and a template 22. The tool holder 16 and the template 22 are realized in one piece as a support body 24 with a recess 26 for the adhesive and positive connection of the cutting insert 20. The cutting insert 20, which can be made of tungsten carbide G 40, can be fastened in the recess 26 using adhesive, whereby inside the recess 26, the side of the cutting insert 20 which faces the support body 24 is in contact over approximately ⅔ of its surface with the support body 24. The recess 26, which extends over the full width of the support body 24, has a projection 28 which is realized in the form of a continuous edge or ridge, against which projection 28 the upper edge of the cutting insert 20 is in contact.

The profiled unfinished concrete roofing tile 14 has side rabbets or grooves, a gutter 30 and a center flap 32 which center flap 32 is somewhat higher than the gutter 30. The underside of the unfinished concrete roofing tile 14 is provided with a profile which runs parallel to the upper side, or top surface, of the unfinished concrete roofing tile 14, which profile was molded into the underside of the unfinished concrete roofing tile 14 by a correspondingly profiled chase 34. The cutting insert 20 is provided with cambers so that the lower edge 36 of the lower edge 12 of the roofing tile runs in the perpendicular transverse plane 38 even when the cut is made at an angle $\alpha$ to the lower perpendicular transverse plane 38 of the unfinished concrete roofing tile 14.

In at least one embodiment of the present invention the template 22 can include a contour or profile which substantially corresponds to the contour or profile formed on the upper side of the roofing tile 14 and to the contour or profile of the portion of the lower edge 12 adjacent to the top surface side of the roofing tile 14. That is, the template can shape the roofing tile 14 in the vicinity of the lower edge 12 to include a portion of the top surface of the roofing tile 14 in the vicinity of the lower edge 12 and at least a portion of the lower edge 12 adjacent to the top surface of the roofing tile 14.

Figure 2:
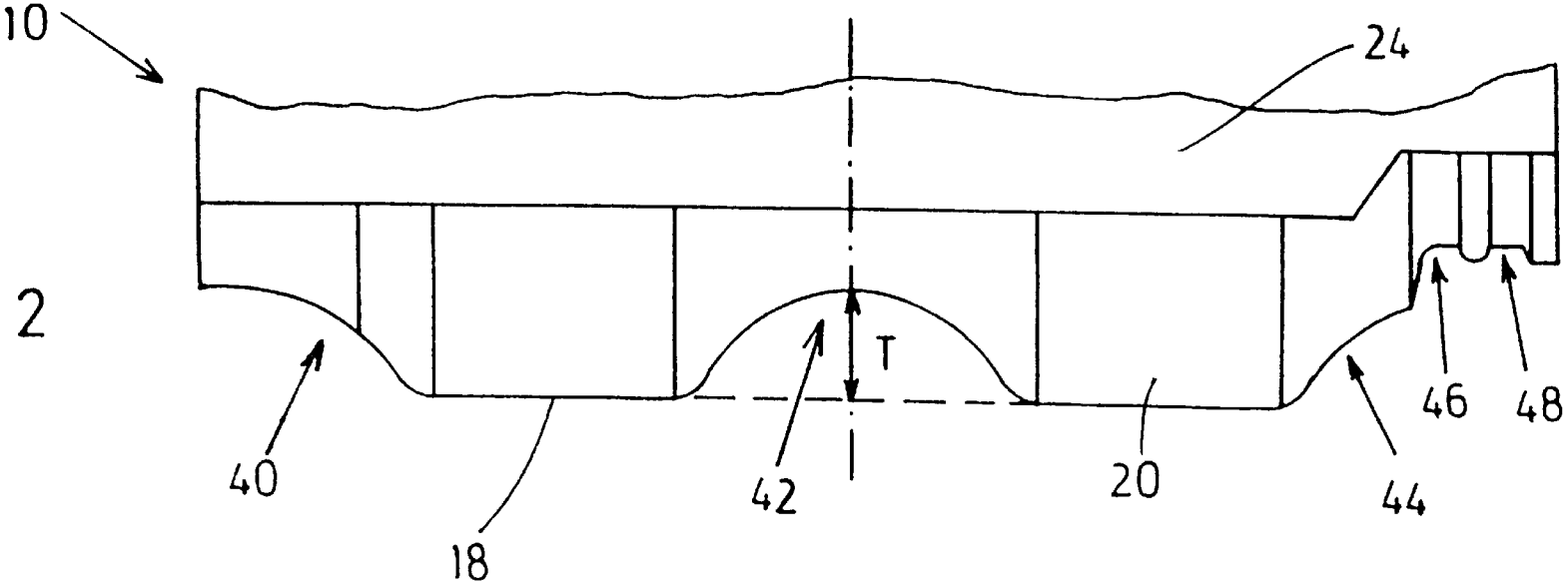
FIG. 2 is a head-on view showing the tool illustrated in FIG. 1.

FIG. 2 is a head-on view of the tool 10 in accordance with at least one embodiment of the present invention. To cut an unfinished concrete roofing tile which is profiled on the underside, the cutting insert 20 fastened to the support body 24 by means of an adhesive connection has a cutting edge 18 which has a contour which is provided with curved notches 40, 42, 44, 46, 48 at different depths. The depth labelled T of the notches 40, 42, 44, 46, 48 thereby corresponds to the height of the profile on the underside of the unfinished concrete roofing tile.

Figure 3:
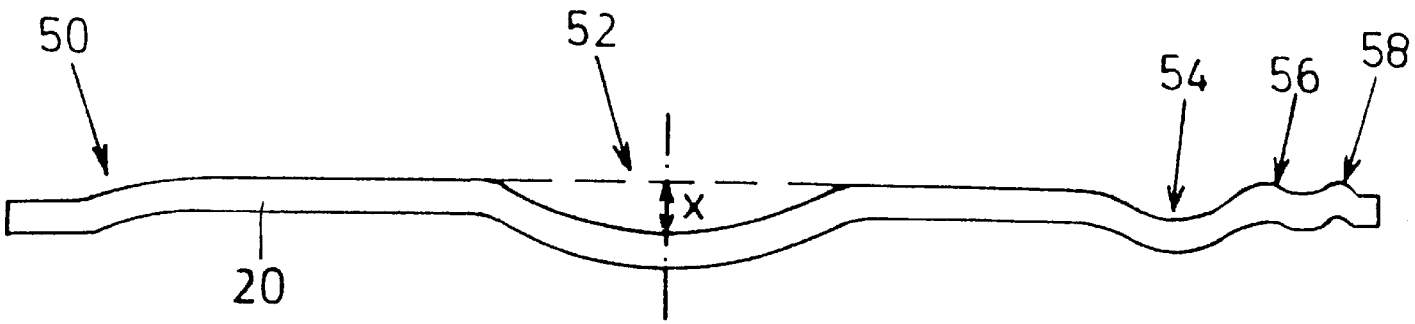
FIG. 3 is an overhead view which shows the cutting insert of the tool illustrated in FIG. 1 and FIG. 2.

FIG. 3 shows an overhead view of the cutting insert 20 of the cutting tool 10 illustrated in FIGS. 1 and 2. So that the lower edge of the lower edge of an unfinished concrete roofing tile runs in the perpendicular transverse plane even during the execution of a cut which runs at an angle $\alpha$ to the lower perpendicular transverse plane of the unfinished concrete roofing tile, the cutting insert 20 is provided with cambers 50, 52, 54, 56, 58. The camber identified by the letter x of the cambers 50, 52, 54, 56, 58 is proportional to the respective depth T of the notches 40, 42, 44, 46, 48 of the contour of the cutting edge 18 (see FIG. 2) and to sin $\alpha$. To manufacture the cutting insert 20, the camber x to be shaped in the cutting insert 20 is calculated on the basis of the mathematical equation $x=T\cdot\sin\alpha$.

One feature of the invention resides broadly in the tool 10 for cutting and shaping a lower edge 12 of a profiled unfinished concrete roofing tile 14 manufactured using the extrusion method, whereby the tool 10 has a tool holder 16, a cutting insert 20 provided with a cutting edge 18, and a template 22, characterized by the fact that the holder 16 and the template 22 are realized in one piece in the form of a support body 24 which has a recess 26 for the adhesive and positive connection of the cutting insert 20, that the cutting insert 20 is made of tungsten carbide and is fastened into the recess 26 using adhesive, and that the cutting insert 20 is in contact by means of its upper edge with at least one projection 28 of the support body 24.

Another feature of the invention resides broadly in the tool characterized by the fact that inside the recess 26, the side of the cutting insert 20 which faces the support body 24 is in contact over at least ⅔ of its surface with the support body 24, so that there is a wide area adhesive connection.

Yet another feature of the invention resides broadly in the tool characterized by the fact that the cutting insert 20 is made of tungsten carbide which has a high degree of toughness, in particular of a tungsten carbide which is classified in Applications Group G 40.

Examples of cutting tools, machinery and/or components thereof, with which at least one embodiment of the present invention might be used in conjunction with may be found in U.S. Pat. Nos.: 5,395,026, issued on Mar. 7, 1995; 5,398,458, issued Mar. 21, 1995; 5,409,299, issued on Apr. 25, 1995; 5,438,757, issued on Aug. 8, 1995; 5,452,705, issued on Sep. 26, 1995; and 5,471,971, issued on Dec. 5, 1995.

Other documents which may contain examples of cutting tools, machinery, and/or components thereof, with which at least one embodiment of the present invention might be used in conjunction with may be found in: Patent Nos.—DE-A-3100673; DE-A-3712700; FR-A-2608090; FR-A-2009149, which corresponds to U.S. Pat. No. 3,843,298; Documents—DE. A, 31 00673 (M. VOM CLEFF) Aug. 12, 1982; DE, A, 37 12 700 (DACHZIEGELWERKE NELSKAMP GMBH) Nov. 3, 1988; FR, A, 2 608 090 (SOCIETE ANONYME TUILERIES MARLEY BETOPAN) Jun. 17, 1988; and FR, A, 2 009 149 (BRAAS & CO., G.M.B.H.) Jan. 30, 1970.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, published patent applications and publications recited herein, and in the Declaration attached hereto, are hereby incorporated by reference as if set forth in their entirety herein as well as the references cited in any of the documents cited herein, are hereby incorporated by reference as if set forth in their entirety herein.

The corresponding foreign and international patent publication applications, namely, Federal Republic of Germany Patent Application No. 195 24 315.3, filed on Jul. 4, 1995, having inventors Helmut Rapp, Heinrich Stephan, and Frank Wojtalewicz, and PCT/DE96/01143, and WO 97/02123, and the published references cited in any of the published documents cited herein, are hereby incorporated by reference as if set forth in their entirety herein.

The details in the patents, published patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A method of using a tool in a roofing tile manufacturing machine for cutting and shaping an unfinished roofing tile, said tool comprising: a tool holder; a cutting insert provided with a cutting edge to cut an edge of a roofing tile; a template to shape at least a portion of an edge of a roofing tile; said holder and said template being realized in one piece, to in combination form a support body; said support body having a recess to receive said cutting insert; said recess comprising a projection; said cutting insert being firmly fastened into said recess; said cutting insert comprising an upper edge; said upper edge of said cutting insert being in contact with said projection of said recess; and apparatus for connecting said tool to a roofing tile manufacturing machine, said method comprising the steps of:

providing a tool holder;

providing a cutting insert comprising tungsten carbide and provided with a cutting edge to cut an edge of a roofing tile;

providing a template to shape at least a portion of an edge of a roofing tile;

providing a support body formed by the holder and the template being realized in one piece to in combination form the support body;

said step of providing a support body comprising providing a recess in the support body to receive the cutting insert;

said step of providing the recess comprising providing the recess comprising a projection;

said step of providing the cutting insert comprising the steps of: configuring the tool to minimize impact and bending stresses of the cutting insert by providing, in combination, the cutting insert being firmly fastened into the recess of the one-piece support body by adhesive and providing an upper edge of the cutting insert being in contact with the projection of the recess;

providing apparatus for connecting the tool to a roofing tile manufacturing machine;

providing a profile to contour at least one roofing tile;

contouring the at least one roofing tile with the profile;

cutting and shaping an edge of one of said at least one roofing tile;

said step of cutting and shaping an edge comprising:

exerting a cutting and shaping force on the tool holder with the tile manufacturing machine;

transmitting force directly from the tool holder into the template to minimize impact and bending stress on the cutting insert;

cutting the unfinished roofing tile with the cutting edge; and shaping at least a portion of the edge with the template.

2. The method according to claim 1, wherein:

said cutting insert has a surface area facing said support body; and said cutting insert being configured and disposed to permit at least about two-thirds of said surface area to be in contact with said support body to permit a substantially wide area for said adhesive connection of said cutting insert to said support body.

3. The method according to claim 2, wherein the cutting insert is made of tungsten carbide with a high degree of toughness.

4. The method according to claim 3 wherein said tool is a tool for shaping concrete roofing tiles manufactured using an extrusion method.

5. The method according to claim 4 wherein said tungsten carbide is classified in Applications Group G 40.

6. A method of using a tool in a roofing tile manufacturing machine for cutting and shaping an unfinished roofing tile, said tool comprising: a tool holder; a cutting insert provided with a cutting edge to cut an edge of a roofing tile; a template to shape at least a portion of an edge of a roofing tile; said holder and said template being realized in one piece, to in combination form a support body; said support body having a recess to receive said cutting insert; said recess comprising a projection; said cutting insert being firmly fastened into said recess; said cutting insert comprising an upper edge; said upper edge of said cutting insert being in contact with said projection of said recess; and apparatus for connecting said tool to a roofing tile manufacturing machine, said method comprising the steps of:

providing a tool holder;

providing a cutting insert comprising a carbide and provided with a cutting edge to cut an edge of a roofing tile;

providing a template to shape at least a portion of an edge of a roofing tile;

providing a support body formed by the holder and the template being realized in one piece to in combination form the support body;

said step of providing a support body comprising providing a recess in the support body to receive the cutting insert;

said step of providing the recess comprising providing the recess comprising a projection;

said step of providing the cutting insert comprising the steps of: configuring the tool to minimize impact and bending stresses of the cutting insert by providing, in combination, the cutting insert being firmly fastened into the recess of the one-piece support body by adhesive and providing an upper edge of the cutting insert being in contact with the projection of the recess;

providing apparatus for connecting the tool to a roofing tile manufacturing machine;

providing a profile to contour at least one roofing tile;

contouring the at least one roofing tile with the profile;

cutting and shaping an edge of one of said at least one roofing tile;

said step of cutting and shaping an edge comprising:

exerting a cutting and shaping force on the tool holder with the tile manufacturing machine;

transmitting force directly from the tool holder into the template to minimize impact and bending stress on the cutting insert;

cutting the unfinished roofing tile with the cutting edge; and shaping at least a portion of the edge with the template.

7. The method according to claim 6 wherein:

said cutting insert has a surface area facing said support body; and said cutting insert is configured and disposed to permit at least about two-thirds of said surface area to be in contact with said support body to permit a substantially wide area for said adhesive connection of said cutting insert to said support body.

8. The method according to claim 7 wherein the hard alloy is tungsten carbide with a high degree of toughness.

9. The method according to claim 8 wherein said tool is a tool for shaping concrete roofing tiles manufactured using an extrusion method.

10. The method according to claim 9 wherein said tungsten carbide is classified in Applications Group G 40.

* * * * *

UNITED STATES PATENT AND TRADEMARK OFFICE

CERTIFICATE OF CORRECTION

PATENT NO. : 6,074,589
DATED : January 13, 2000
INVENTOR(S) : Helmut Rapp, Heinrich Stephan, and Frank Wojtalewicz It is certified that error appears in the above-identified patent and that said Letters Patent is hereby corrected as shown below:

On the title page, item [54], line 1, after 'SHAPING' delete "AN".

On the title page, item [54], line 2, after 'UNFINISHED' delete "CONCRETE".

Column 1:
Line 1 of the title, after 'SHAPING' delete "AN".

Column 1:
Line 2 of the title, after 'UNFINISHED' delete "CONCRETE".

Signed and Sealed this

Twelfth Day of June, 2001

*Attest:*

*Attesting Officer*

Nicholas P. Godici

NICHOLAS P. GODICI

*Acting Director of the United States Patent and Trademark Office*